US005442258A

United States Patent [19]

Shibata

[11] Patent Number: 5,442,258

[45] Date of Patent: Aug. 15, 1995

[54] LED LAMP DEVICE

[75] Inventor: Yoshihiko Shibata, Kiyose, Japan

[73] Assignee: Hakuyo Denkyu Kabushiki Kaisha, Kiyose, Japan

[21] Appl. No.: 237,862

[22] Filed: May 4, 1994

[51] Int. Cl.[6] ..... H01J 1/60

[52] U.S. Cl. ..... 315/129; 315/136; 315/200 A; 315/185 S

[58] Field of Search ..... 315/129, 136, 200 A, 315/209 R, 185 S

[56] References Cited

U.S. PATENT DOCUMENTS 3,530,501 9/1970 Van Benschoten ..... 315/129
5,061,879 10/1991 Munoz et al. ..... 315/129
5,223,678 6/1993 McCurrach ..... 315/129

*Primary Examiner*—Benny Lee
*Assistant Examiner*—Reginald A. Ratliff
*Attorney, Agent, or Firm*—Armstrong, Westerman, Hattori, McLeland & Naughton

[57] ABSTRACT

An LED lamp device is made up of an LED emitter, a pair of DC voltage input terminals, a circuit connecting between the LED emitter and the pair of DC voltage input terminals, and at least one constant-voltage diode and at least one constant-current diode which are interposed in the circuit. The LED lamp device further has an adapter for mounting on one end thereof the LED emitter, and a base fixed to the other end of the adapter. The lighting parts such as the constant-voltage diode or the like are contained inside the adapter and the base.

5 Claims, 1 Drawing Sheet

LED LAMP DEVICE

BACKGROUND OF THE INVENTION

1. Field of the Invention

The present invention relates to an LED (Light Emitting Diode) lamp device to be used as an indicating lamp, an illuminating lamp for a switch or the like, which is connected to a DC power source or an AC power source.

2. Description of Related Art

In case an LED lamp device is lighted by a commercial power source (normally 100 V–200 V), it has conventionally been normal practice to step down the voltage of the commercial power source to a low-voltage range (normally 24 V) that is suitable for an LED emitter (or illuminant) by means of a transformer or the like and then to convert it to DC and control the current value by means of a resistor or the like.

It has also been normal practice to convert the voltage of the commercial power source to a DC voltage and then to control the current value by means of a resistor or the like to light the LED lamp device.

The LED lamp device has increased its brightness and has secured a reliability, with the result that a demand for the LED lamp device has increased. However, in case the LED lamp device is connected to the commercial power source to light it up, there is the following disadvantage. Namely, as can be seen from the above-described construction, parts for lighting up such as a transformer, a resistor or the like become bigger in volume than the LED emitter. As a result, it is not possible any more to take advantage of the merit in that the LED emitter is small in size and, therefore, candescent lamps must be largely relied upon.

The present invention has been made in view of the above-described disadvantage and has an object of providing an LED lamp device that is small in size and can be used with the commercial power source or a DC power source of the voltage that corresponds to the voltage of the commercial power source.

SUMMARY OF THE INVENTION

In order to attain the above and other objects, the present invention is an LED lamp device comprising an LED emitter, a pair of DC voltage input terminals, a circuit connecting between the LED emitter and the pair of DC voltage input terminals, and at least one constant-voltage diode and at least one constant-current diode which are interposed in the circuit. Preferably, the DC voltage input terminals may be connected, as DC power source connection terminals, to a DC power source. Or they may be connected to AC power source connection terminals or to DC power source connection terminals via a rectifying circuit so that either the AC power source connection terminals or the DC power source connection terminals can be connected to a commercial power source or a DC power source. Further, preferably, the LED emitter is mounted on one end of an adapter, the other end of the adapter being fixed to a base, and the lighting parts such as the constant-voltage diode or the like are contained inside the adapter and the base.

Since the LED emitter is connected to the DC voltage input terminals via the constant-voltage diode and the constant-current diode, that DC voltage corresponding to the commercial power source which is outputted from the DC voltage input terminals are mostly absorbed by the constant-current diode and the remaining voltage is mostly absorbed by the constant-current diode. The electric current that flows to the LED emitter is controlled by the constant-current diode to an allowable value for the LED emitter. Since the constant-voltage diode and the constant-current diode are small in size, the LED lamp device made up of these lighting parts and the LED emitter becomes small in size.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF PREFERRED EMBODIMENTS

A detailed explanation will now be made with reference to embodying examples.

Figure 1:
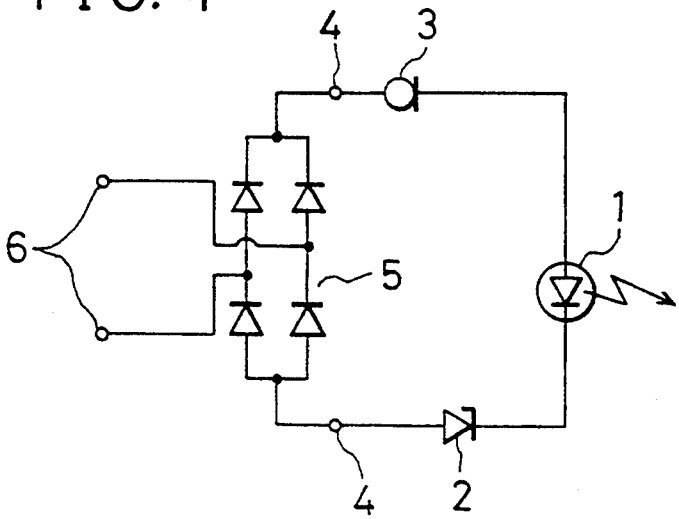
FIG. 1 is a circuit diagram of an embodying example of the present invention.

FIG. 1 shows a circuit diagram of one example of the present invention.

In the Figure, numeral 1 denotes an LED emitter (or illuminant), numeral 2 denotes a constant-voltage diode and numeral 3 denotes a constant-current diode. The LED emitter 1 is connected to DC input terminals 4, 4 via the constant-voltage diode 4 and the constant-current diode 3. The DC input terminals 4, 4 are connected to AC power source connection terminals 6, 6 via a full-wave rectifying circuit 5. The connection terminals 6, 6 are connected to the commercial power source of 100 V.

The current value that is required for lighting the LED emitter 1 is about, e.g., 0.02 A and the voltage is about 2 V. In case the DC output voltage is 70 V, the constant-voltage diode 2 can be so arranged that, when an element of breakdown voltage of about 70 V is used, the LED emitter 1 can be arranged to be not lighted by a voltage smaller than about 70 V. As the constant-current diode 3, there is used such a one taking into consideration the current value, e.g., 0.02 A, that is required for lighting the LED emitter 1 in the range of 100 V in maximum. However, taking into consideration the safety in operation, one in the neighborhood of 0.013 A is employed. Considering the heat dissipation, it is preferable to use the constant-current diode 3 at about 50% of the maximum voltage, i.e., at about 50 V. If the direct current input voltage is supposed to be 110 V and provided that the voltage to be controlled by the constant-voltage diode 2 is about 70 V, the balance of the voltage between the input voltage and the above-described voltage, i.e., about 40 V is applied to the constant-current diode 3 and the LED emitter 1. The current for lighting the LED emitter 1 is controlled by this constant-current diode 3.

In the circuit of FIG. 1, there is used no resistor. However, in case noises or the like are contained in the DC input voltage, a resistor may be interposed in the circuit, to remove the noises or the like.

Figure 2:
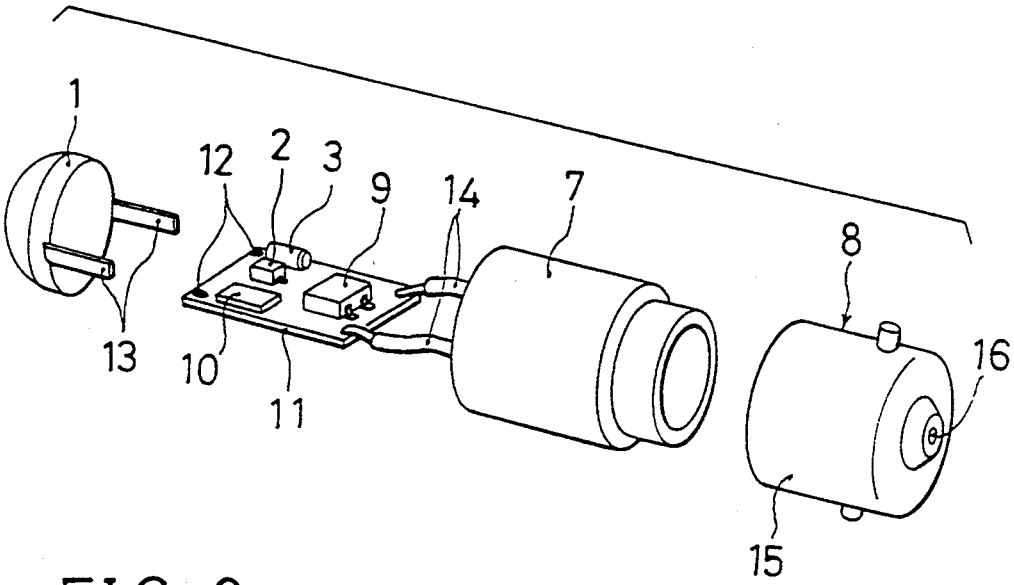
FIG. 2 is an exploded perspective view of the embodying example.

FIG. 2 shows an exploded view of the LED lamp device in the above-described embodiment.

The above-described LED emitter 1 is mounted on one end of an adapter 7 which is made of an electrically insulating material. On the other end of the adapter 7, there is fixed a base 8 according to the standard of, e.g., JIS (Japanese Industrial Standards) BA9S. Inside the adapter 7 and the base 8 there are contained the lighting parts such as the above-described constant-voltage diode 2 or the like.

The lighting parts such as the constant-voltage diode 2, the constant-current diode 3, rectifying circuit parts 9, a resistor 10 or the like constitute a hybrid IC (integrated circuit) by mounting them on a printed circuit board. To terminals 12, 12 of the printed circuit board 11 there are connected terminals 13, 13 of the LED emitter 1. Lead wires 14, 14 which are connected to the rectifying circuit parts 9 are connected to a shell 15 and a contact plate 16 of the base 8.

The above-described lighting parts may be integrated into a single piece of semiconductor IC.

Figure 3:
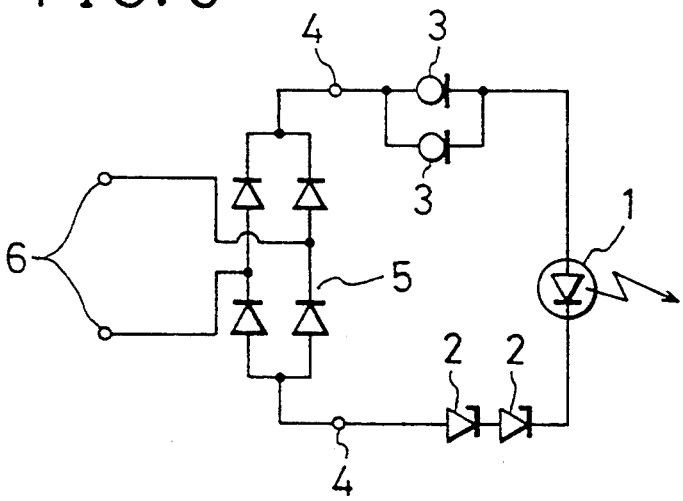
FIG. 3 is a circuit diagram of another embodying example of the present invention.

FIG. 3 shows a circuit diagram of another embodying example of the present invention. In the Figure, for the sake of safety, two constant-voltage diodes 2, 2 are connected in series and/or two constant-current diodes 3, 3 are connected in parallel depending on the current value of the LED emitter 1. The constant-voltage diodes 2, 2 and the constant-current diodes 3, 3 are not necessarily limited to two in number.

When the LED lamp device is used for DC power source, the following construction is preferable though the one shown in FIGS. 1, 2 and 3 may also be used. Namely, the full-wave rectifying circuit 5 and the rectifying circuit parts 9 are removed, and the DC voltage input terminals 4, 4 are made to serve as the terminals for connection to the DC power source.

As can be seen from the above description, since the present invention has the above-described construction, it has an advantage in that a small-sized LED lamp device that can be used with the commercial power source or a DC power source whose voltage corresponds to the voltage of the commercial power source can be obtained.

It is readily apparent that the above-described LED lamp device meets all of the objects mentioned above and also has the advantage of wide commercial utility. It should be noted that the specific form of the invention hereinabove described is intended to be representative only, as certain modifications within these teachings will be apparent to those skilled in the art.

Accordingly, reference should be made to the following claims in determining the full scope of the invention.

What is claimed is:

1. An LED lamp device comprising:

an LED emitter;

a pair of DC voltage input terminals;

a circuit connecting between said LED emitter and said pair of DC voltage input terminals; and at least one constant-voltage diode and at least one constant-current diode which are interposed in said circuit.

2. An LED lamp device according to claim 1, wherein said DC voltage input terminals are adapted to be connected to AC power source connection terminals or to DC power source connection terminals via a rectifying circuit.

3. An LED lamp device according to claim 1, wherein said DC voltage input terminals are DC power source connection terminals.

4. An LED lamp device according to any one of claims 1 through 3, further comprising an adapter for mounting on one end thereof said LED emitter, and a base fixed to the other end of said adapter, wherein lighting parts are contained inside said adapter and said base.

5. An LED lamp device according to claim 4 wherein said lighting parts include a constant voltage diode.

* * * * *